US005701111A

United States Patent [19]

Castonguay et al.

[11] Patent Number: 5,701,111

[45] Date of Patent: Dec. 23, 1997

[54] ELECTRONIC TRIP UNIT CONVERSION KIT FOR HIGH AMPERE-RATED CIRCUIT BREAKERS

[75] Inventors: Roger N. Castonguay, Terryville; Jeffrey D. Lord, Unionville, both of Conn.

[73] Assignee: General Electric Company, New York, N.Y.

[21] Appl. No.: 626,200

[22] Filed: Mar. 29, 1996

[51] Int. Cl.[6] ..... H01H 9/00

[52] U.S. Cl. ..... 335/177; 335/23; 335/172; 335/167

[58] Field of Search ..... 335/23–25, 167–176

[56] References Cited

U.S. PATENT DOCUMENTS

| | | | |
|---|---|---|---|
| 3,073,936 | 1/1963 | Baird . | |
| 3,761,778 | 9/1973 | Willard . | |
| 4,672,501 | 6/1987 | Bilac et al. . | |
| 4,931,758 | 6/1990 | Bagalini | 335/174 |
| 5,006,826 | 4/1991 | Knoben et al. | 335/35 |
| 5,453,724 | 9/1995 | Seymour et al. | 335/172 |

OTHER PUBLICATIONS

U.S. application No. 08/551,640, Castonguay & Lord, filed Nov. 1, 1995.

*Primary Examiner*—Lincoln Donovan

*Attorney, Agent, or Firm*—Richard A. Menelly; Carl B. Horton

[57] ABSTRACT

A field-installable circuit breaker trip actuator unit includes a flux shifter unit that interfaces with the circuit breaker operating mechanism and is installable without dismantling the circuit breaker components. The flux shifter unit responds to an electronic trip unit to articulate the circuit breaker operating mechanism and separate the circuit breaker contacts upon occurrence of an overcurrent condition. A reset arrangement allows the trip actuator unit to be automatically reset upon completion of the contact separation process.

13 Claims, 3 Drawing Sheets

ELECTRONIC TRIP UNIT CONVERSION KIT FOR HIGH AMPERE-RATED CIRCUIT BREAKERS

BACKGROUND OF THE INVENTION

High ampere-rated circuit breakers such as described within U.S. Pat. No. 3,073,936 entitled "Electric Circuit Interrupter" are currently employed within industrial manufacturing facilities to protect the electric equipment and buildings from damage due to overcurrent conditions within the electrical distribution system. Earlier manufactured circuit breakers employed thermal-magnetic trip units to determine overcurrent conditions and to articulate the circuit breaker operating mechanism to separate the circuit breaker contacts to interrupt the associated electric circuit. Later manufactured circuit breakers employed electronic trip units which contained so-called "flux shifters" to articulate the operating mechanism upon signal from the electronic trip unit. One example of an early electronic trip unit is found in U.S. Pat. No. 3,761,778 entitled "Static Trip Control Unit for Electric Circuit Breaker".

Such robust circuit breakers remain in operation to this date without needing replacement or repair. However, state of the art digital trip units of the type described within U.S. Pat. No. 4,672,501 entitled "Circuit Interrupter and Controller Unit" provide more reliable protection by better control over the circuit interruption time and current parameters. It would be economically advantageous to incorporate state of the art digital trip units within existing circuit breakers without having to dismantle the circuit breaker operating components in the process.

One purpose of the invention, accordingly, is to provide a conversion unit that will incorporate digital trip units within existing circuit breakers without having to dismantle the circuit breaker operating components.

SUMMARY OF THE INVENTION

In accordance with the invention, an electronic trip unit conversion kit includes a flux shifter and reset arrangement to articulate the circuit breaker operating mechanism upon the occurrence of an overcurrent condition to separate the circuit breaker contacts and to reset the flux shifter after the circuit breaker contacts have become separated.

DESCRIPTION OF THE PREFERRED EMBODIMENT

Figure 1:
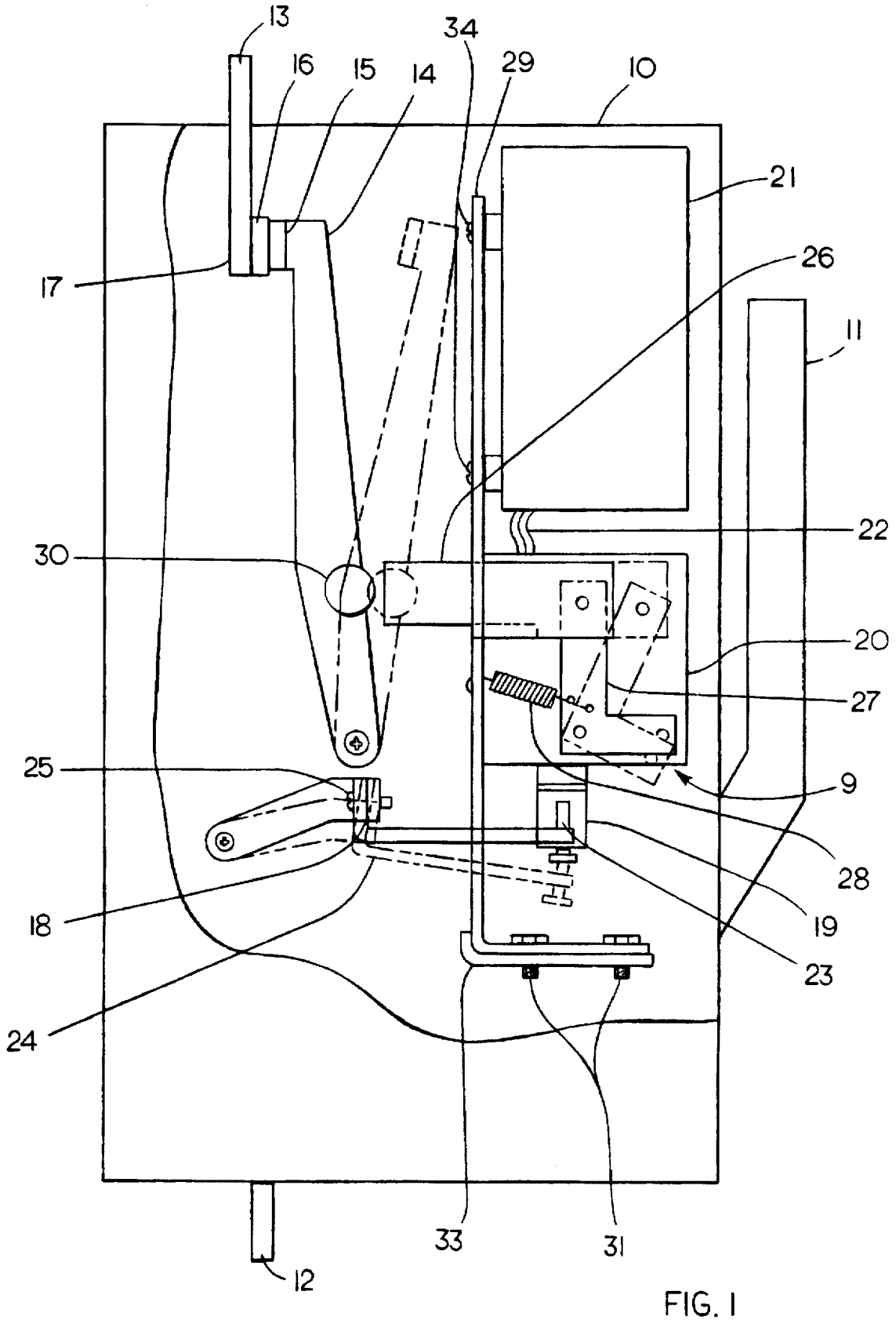
FIG. 1 is a side view of a circuit breaker with a part of the case removed to depict the circuit breaker contact arms, contacts and associated trip actuator in accordance with the invention.

FIG. 1 shows an industrial-rated circuit breaker 10, such as described in aforementioned U.S. Pat. No. 3,073,936, with an operating handle 11 extending from the top with load straps 12 and line straps 13 arranged at opposite ends thereof. The movable contacts 15 at one end of the movable contact arm 14 and the fixed contacts 16 on the contact support 17 are shown in solid lines in the CLOSED condition and in phantom lines in the OPEN condition. As described in the aforementioned U.S. Pat. No. 3,073,936, the condition of the contacts are controlled by an operating mechanism (not shown) that is refrained from articulation by means of a trip latch 18.

In accordance with the invention, a trip unit conversion kit 9 includes a programmer or electronic trip unit 21 such as described in aforementioned U.S. Pat. No. 4,672,501 that connects with a trip actuator unit 20 by means of a wire conductor 22 and connectors 22A at one end. The trip actuator 20 is similar to that described in U.S. patent application Ser. No. 08/551,640 filed Nov. 11, 1995 entitled "Electronic Trip Unit Conversion Kit for High Ampere-Rated Circuit Breakers". Upon receipt of a trip signal from the trip unit, the trip actuator releases the trip plunger 19 from the trip actuator unit 20 which strikes a trip latch adjusting screw 23. The adjusting screw 23 is threaded into a trip latch extension 24 which is secured to the trip latch 18 by means of screw 25. The trip plunger 19 rotates the trip latch 18 to the position shown in phantom allowing the operating mechanism (not shown) to separate the contacts 15, 16 as described in the aforementioned U.S. Pat. No. 3,073,936. The connector link 26 is attached to the reset arm 27 within the trip actuator unit 20 to return the trip plunger 19 from the actuated position depicted in solid lines to the reset position shown in phantom. The connector link 26 is then returned to the solid position under the urgence of the return spring 28 which is connected to the reset arm 27 and mounting bracket 29 in the trip actuator unit 20. The connector link 26 interacts with the circuit breaker cross bar 30 to reset the trip actuator unit 20 as shown in phantom in the manner described in the aforementioned U.S. patent application Ser. No. 08/551,640. The trip unit conversion kit 9 is attached to the circuit breaker interior by the mounting bracket 33 and screws 31 and to the trip unit 21 by means of the mounting bracket 29 and screws 34.

Figure 2:
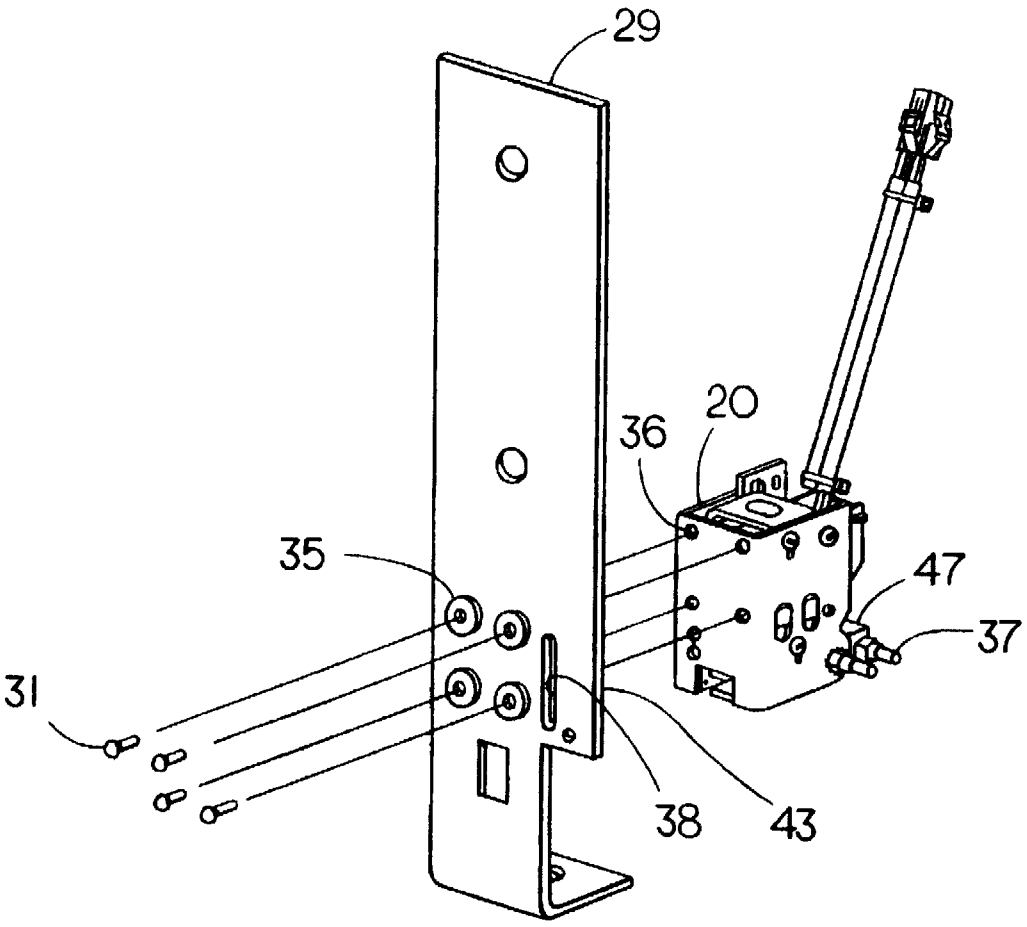
FIG. 2 is a top perspective view of the components of the trip actuator of FIG. 1.
Figure 3:
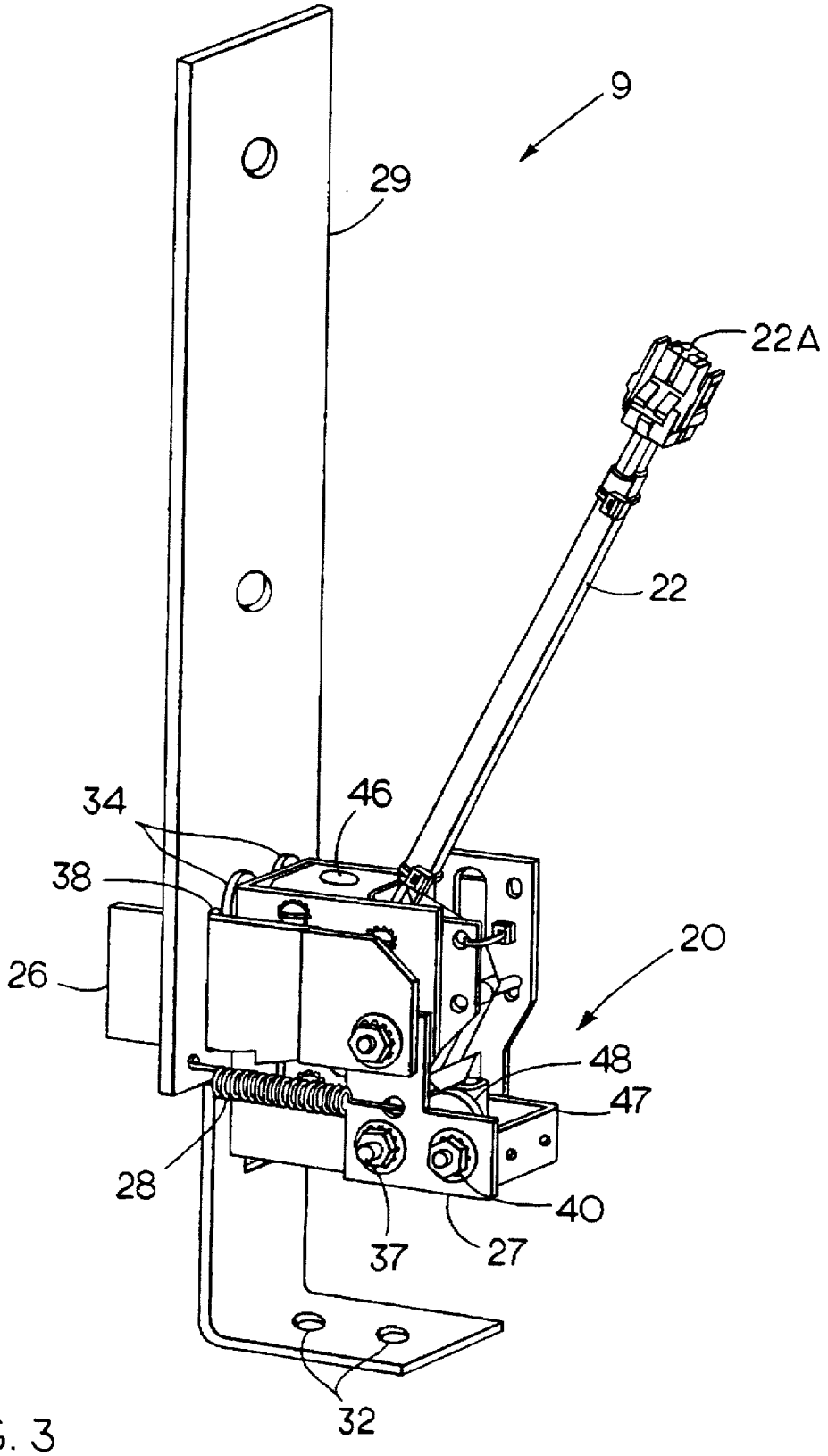
FIG. 3 is a top perspective view of the trip actuator of FIG. 2 with the components completely assembled.

As shown in FIGS. 2 and 3, the trip actuator unit 20 is attached to the mounting bracket 29 via rubber grommets 35, mounting screws 31, and threaded openings 36. The use of rubber grommets substantially reduces the transmission of shock or vibration generated within the circuit breaker from affecting the trip actuator unit 20. The connector link 26 is positioned within the guide slot 38 in the mounting bracket 29 at one end and is pivotally-attached to the reset arm 27 by a screw 37 and a nut 40 at the other end. The reset arm 27 is attached to the flux shift unit reset bracket 47 within the trip actuator unit 20, which contains the flux shift unit 46, by means of the screws 37 and nuts 43. The position of the flux shift reset bracket 47 is determined by the reset spring 48 in the manner described in the aforementioned U.S. patent application Ser. No. 08/551,640. Upon displacement of the connector link 26 by the circuit breaker cross bar 30 in FIG. 1, the reset arm 27 rotates flux shift reset bracket 47 against the return bias of the flux shift return spring 48 to return the plunger to the home position as shown in solid lines. The trip actuator 20 is mounted to the circuit breaker mounting bracket 33 by means of the pair of apertures 32.

A trip unit conversion kit with means for automatically resetting the flux shift unit has been described herein. The conversion kit provides electronic trip facility to high ampere-rated circuit breakers by on site field installation.

We claim:

1. A trip unit conversion kit for circuit breakers comprising:

a trip actuator unit responsive to a trip initiating signal from a circuit breaker trip unit to articulate a circuit breaker operating mechanism and separate a pair of circuit breaker contacts, said trip actuator unit including a flux shift unit having a flux shift plunger;

a reset arm pivotally arranged on said trip actuator unit and connecting with said flux shift plunger;

a connector link attached to said reset arm at one end and arranged for interacting with a circuit breaker cross bar at an opposite end, whereby said cross bar motivates said connector link and said reset arm upon separation of said circuit breaker contacts; and a reset spring attached to said reset arm for returning said reset arm and said connector link to a home position, said reset spring connects with said connector link at one end of said return spring and connects with said support bracket at an opposite end of said return spring.

2. The trip unit conversion kit of claim 1 including a support bracket, whereby said opposite end of said connector link passes through a clearance slot in said support bracket for alignment with said cross bar.

3. The trip unit conversion kit of claim 1 wherein said support bracket further attaches to a part of a circuit breaker trip unit.

4. The trip unit conversion kit of claim 1 wherein said reset arm comprises an L-shaped plate.

5. The trip unit conversion kit of claim 1 where in said reset arm is attached to a reset bracket on said flux shift unit by means of a flexible grommet.

6. The trip unit conversion kit of claim 5 wherein said flux shift unit includes a flux shift reset spring.

7. A circuit breaker comprising:

an enclosure;

a pair of contacts within said enclosure for interrupting circuit current on command;

a line strap on one end of said enclosure for connecting said contacts with an electrical source;

a line strap on an opposite end of said enclosure for connecting said contacts with electrical equipment;

an operating handle extending from said enclosure for manual control of said operating mechanism;

electronic means for providing a trip initiating signal to a trip actuator, said trip actuator including:

a flux shift unit having a flux shift plunger;

a reset arm pivotally arranged on said trip actuator unit and connecting with said flux shift plunger;

a connector link attached to said reset arm at one end and arranged for interacting with a circuit breaker cross bar at an opposite end, whereby said cross bar motivates said connector link and said reset arm upon separation of said circuit breaker contacts; and a reset spring attached to said reset arm for returning said reset arm and said connector link to a home position, said reset spring connects with said connector link at one end of said return spring and connects with said support bracket at an opposite end of said return spring.

8. The circuit breaker of claim 7 including a support bracket, whereby said opposite end of said connector link passes through a clearance slot in said support bracket for alignment with said cross bar.

9. The circuit breaker of claim 8 wherein said support bracket further attaches to a part of a circuit breaker trip unit.

10. The circuit breaker of claim 7 wherein said reset arm comprises an L-shaped plate.

11. The circuit breaker of claim 8 wherein said support bracket further attaches to a part of a circuit breaker trip unit.

12. The circuit breaker of claim 7 wherein said reset arm is attached to a reset bracket on said flux shift unit by means of a flexible grommet.

13. The circuit breaker of claim 7 wherein said flux shift unit includes a flux shift reset spring.

* * * * *